US007687444B2

(12) United States Patent
Nagamatsu

(10) Patent No.: US 7,687,444 B2
(45) Date of Patent: Mar. 30, 2010

(54) LUBRICATING OIL COMPOSITION HAVING IMPROVED OXIDATION STABILITY AT HIGH TEMPERATURES

(75) Inventor: Hiroyuki Nagamatsu, Gotenba (JP)

(73) Assignee: Chevron Japan Ltd., San Ramon, CA (US)

( * ) Notice: Subject to any disclaimer, the term of this patent is extended or adjusted under 35 U.S.C. 154(b) by 699 days.

(21) Appl. No.: 11/316,574

(22) Filed: Dec. 20, 2005

(65) Prior Publication Data

US 2007/0142241 A1 Jun. 21, 2007

(51) Int. Cl.
*C10M 159/22* (2006.01)
*C10M 129/54* (2006.01)
*C10M 133/56* (2006.01)

(52) U.S. Cl. ..... 508/460; 508/192; 508/518

(58) Field of Classification Search ..... 508/192, 508/291, 460, 518
See application file for complete search history.

(56) References Cited

U.S. PATENT DOCUMENTS 6,262,001 B1 * 7/2001 Le Coent et al. ..... 508/518
6,569,819 B2 * 5/2003 Yagishita et al. ..... 508/291
6,583,092 B1 * 6/2003 Carrick et al. ..... 508/198
2003/0004069 A1 * 1/2003 Hammond et al. ..... 508/460

FOREIGN PATENT DOCUMENTS

JP 2000-63867 2/2000
JP 2000-87066 3/2000

* cited by examiner

*Primary Examiner*—Glenn Caldarola
*Assistant Examiner*—Jim Goloboy
(74) *Attorney, Agent, or Firm*—Claude J. Caroli; M. Carmen & Associates, PLLC

(57) ABSTRACT

A lubricating oil composition having a TBN in the range of 5 to 55 mg KOH/g and containing a major amount of a base oil of lubricating viscosity and a) 0.19 to 2.10 wt %, based on the total amount of the lubricating oil composition, of an overbased calcium carboxylate having a TBN of 100 mg KOH/g or more, wherein the wt % is expressed in terms of the calcium content;

b) 0.002 to 0.06 wt %, based on the total amount of the lubricating oil composition, of a bis-succinimide compound, wherein the wt % is expressed in terms of the nitrogen content; and c) 0.007 to 0.15 wt %, based on the total amount of the lubricating oil composition, of a zinc dialkyldithiophosphate having a secondary alkyl group, wherein the wt % is expressed in terms of the phosphorus content.

8 Claims, No Drawings

LUBRICATING OIL COMPOSITION HAVING IMPROVED OXIDATION STABILITY AT HIGH TEMPERATURES

CROSS REFERENCE TO RELATED APPLICATIONS

This application claims priority from Japanese Patent Application Number 2004-380522, filed Dec. 28, 2004.

The present invention relates to a lubricating oil composition. More particularly, the present invention relates to a lubricating oil composition having improved oxidation stability at high temperatures when employed in an internal combustion engines.

BACKGROUND OF THE INVENTION

Diesel engines, particularly four stroke trunk piston diesel engines, are generally employed as internal combustion engines for generation of electric power and operation of marine vessels. These internal combustion engines are operated smoothly using a lubricating oil composition which contains various additives.

Generally, most additives employed in lubricating oil compositions are metal-containing detergents. Specifically, an over-based metal-containing detergent which neutralizes sulfur oxide produced by the combustion of fuel and disperses combustion deposits such as sludge is generally employed. Particularly, a lubricating oil composition for marine diesel engines which is operated using high sulfur content fuel such as A-heavy oil or C-heavy oil should contain over-based metal-containing detergents. Most metal-containing detergents are alkaline earth metal sulfonates, alkaline earth metal phenates, and alkaline earth metal salicylates. An ashless dispersant such as succinimide is also generally employed. Examples of other generally employable additives include a zinc dialkyldithio-phosphate compound which serves as an anti-oxidation agent and an extreme-pressure agent and an organic anti-oxidation agent such as phenol compound and amine compound.

Recently, the operation conditions of diesel engines for generation of electric power and operation of marine vessel have been getting severe. In addition, these diesel engines are forced to employ a low grade fuel having increased sulfur content. Moreover, the recent demand for economical operation and increase of maintenance efficiency requires extended service periods for using a lubricating oil with no substantial exchange. Therefore, the load applied to the lubricating oil has increased recently.

The lubricating oil is consumed during the operation of engines. Although a fresh lubricating oil is supplemented periodically to compensate the consumed portion, the amount of sulfur oxide compounds and combustion residues produced and deposited in the remaining lubricating oil increases. Therefore, after the engine is operated continuously for a long period of time, the lubricating oil suffers from deterioration and viscosity increase.

Japanese Provisional Patent Publication 2000-63867, U.S. Pat. No. 6,262,001 B1 and Japanese Provisional Patent Publication 2000-87066 disclose a metal-containing overbased calcium carboxylate (i.e., overbased calcium hydrocarbyl-salicylate carboxylate) having high thermal stability and high detergency. It can be prepared with low production costs. These publications describe a variety of compositions for engine lubricating oils.

SUMMARY OF THE INVENTION

As previously mentioned, the present invention relates to a lubricating oil composition having high thermal oxidation stability at high temperatures which are favorably employable for lubricating various internal combustion engines such as diesel engines and gasoline engines. For example the lubricating oil composition of the present invention is very favorably employed in four stroke trunk piston diesel engines.

Accordingly, the present invention relates to a lubricating oil composition having a TBN in the range of 5 to 55 mg KOH/g comprising a base oil of lubricating viscosity and a) 0.19 to 2.10 wt %, based on the total amount of the lubricating oil composition, of an overbased calcium carboxylate having a TBN of 100 mg KOH/g or more, wherein the wt % is expressed in terms of the calcium (Ca) content;

b) 0.002 to 0.06 wt %, based on the total amount of the lubricating oil composition, of a bis-succinimide compound wherein, the wt % is expressed in terms of the nitrogen (N) content; and c) 0.007 to 0.15 wt %, based on the total amount of the lubricating oil composition, of a zinc dialkyldithiophosphate having a secondary alkyl group, wherein the wt % is expressed in terms of the phosphorus (P) content.

In a further embodiment the present invention relates to a method of improving the oxidation stability at high temperatures of an internal combustion engine, particularly a four stroke trunk piston diesel engine, by operating the internal combustion engine with the lubricating oil composition of the present invention.

Among other factors, the present invention is based on the surprising discovery that a certain lubricating oil composition provides improved high temperature oxidation stability when employed in internal combustion engines such as diesel engines and gasoline engines.

DETAILED DESCRIPTION OF THE INVENTION

In its broadest aspect, the present invention relates to a lubricating oil composition having a major amount of base oil of lubricating viscosity and an overbased calcium carboxylate, bis-succinimide compound and a zinc dialkylthidiophosphate, wherein the TBN of the lubricating oil composition is in the range of 5 to 55 mg KOH/g.

Base Oil of Lubricating Viscosity

The base oil of lubricating viscosity employed in the lubricating oil composition of the present invention generally is a mineral oil or a synthetic oil having a dynamic viscosity in the range of 22 to 300 $mm^2/s$ at 40° C. There are no specific limitations with respect to the nature and other characteristics of the mineral oil and synthetic oil. However, the sulfur content of the base oil is preferably not less than 0.1 wt %, more preferably less than 0.03 wt %, most preferably less than 0.005 wt %.

The mineral oil is preferably prepared by processing a mineral oil of lubricating oil distillate by an appropriate combination of solvent purification and hydrogenation processing. Most preferred is a mineral oil having been subjected to high hydrogenation processing (i.e., hydrogenation cracking) that advantageously shows a viscosity index in the range of 100 to 150 and has an aromatic component content of less than 5 wt %, a nitrogen content of less than 50 ppm, and a sulfur content of less than 50 ppm. The above-identified most preferred mineral oil can be a high viscosity index base oil which is prepared by processing synthetic wax by isomerization and hydrogenation cracking. The synthetic wax was prepared by mineral slack was (crude wax) or natural gas.

The synthetic oil (synthetic base oil) can be poly-α-olefin (polymer prepared from α-olefin having 3 to 12 carbon atoms), a sebacic acid compound such as dioctyl sebacate, a dialkyl diester prepared from a dibasic acid such as azelaic acid or adipic acid and an alcohol having 4 to 18 carbon atoms, a polyol ester prepared from 1-trimethylolpropane or pentaerythritol and a monobasic acid, or an alkylbenzene having alkyl of 9 to 40 carbon atoms.

The synthetic oil generally contains no sulfur compound and shows high thermal stability and high heat resistance. Moreover, the synthetic oil produces little soot and carbonaceous deposit. Therefore, the synthetic oil is preferred as the base oil for the lubricating oil composition of the present invention.

Each of the mineral base oil and synthetic base oil can be employed singly. However, if desired, two or more of mineral base oils or two or more of synthetic base oils can be employed in combination. Further, if desired, one or more mineral base oils and one or more synthetic base oils can be employed in combination.

It is preferred to use a major amount of base oil of lubricating viscosity in the lubricating oil composition of the present invention. A major amount of base oil of lubricating viscosity as defined herein comprises 40 wt % or more. Preferred amounts of base oil comprise 40 wt % to 97 wt %, preferably greater than 50 wt % to 97 wt %, more preferably 60 wt % to 97 wt % and most preferably 80 wt % to 95 wt % of the lubricating oil composition. (When weight percent is used herein, it is referring to weight percent of the lubricating oil composition unless otherwise specified.)

Overbased Calcium Carboxylate

The overbased calcium carboxylate employed in the lubricating oil of the present invention has a TBN of 100 mg KOH/g or more and can be prepared in the manner described in the aforementioned references cited in the Background of the Invention. The overbased calcium carboxylate will be in the amount of 0.19 to 2.10 wt %, preferably 0.38 to 1.15 wt %, based on the total amount of the lubricating oil composition and expressed in terms of the calcium content. A representative example of the overbased calcium carboxylate comprises a relatively large amount (more than 50 wt %) of the following compound A and a relatively small amount (less than 50 wt %) of the following compound B:

Compound A

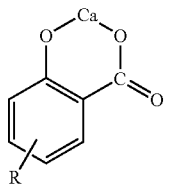

Compound B

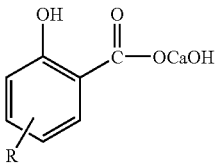

in which R is an alkyl group having 12 to 28 carbon atoms.

The lubricating oil composition of the present invention can contain other metal-containing detergents in addition to the overbased calcium carboxylate. Examples of other metal-containing detergents employable in combination with the overbased calcium carboxylate include sulfurized phenate (e.g., sulfurized calcium phenate), petroleum sulfonates or synthetic sulfonates (e.g., calcium sulfonate), and salicylate (e.g., calcium salicylate).

Bis-Succinimide Compound

The lubricating oil composition of the present invention contains a bis-succinimide compound (i.e., succinimide or its derivatives) in the amount of 0.002 to 0.06 wt %, preferably 0.014 to 0.02 wt %, based on the total amount of the lubricating oil composition and expressed in terms of the nitrogen content. The bis-succinimide compound preferably is an alkenylsuccinimide or an alkylsuccinimide derived from a polyolefin compound or its derivatives. The bis-succinimide can be prepared, for example, by a reaction between succinic anhydride and a high molecular weight alkenyl or alkyl, followed by further reaction with a polyalkylenepolyamine containing 4 to 10, preferably 5 to 7, nitrogen atoms per molecule. For example, the bis-succinimide compound can be prepared by a thermal reaction between a polybutene compound containing 50% or more methylvinylidene structure and maleic anhydride, followed by reaction of the resulting polybutenyl succinic anhydride with a polyalkylenepolyamine containing 4 to 10, preferably 5 to 7, nitrogen atoms per molecule. The high molecular weight alkenyl or alkyl group preferably is polybutene having a number-average molecular weight in the range of approximately 900 to 5,000.

The bis-succinimide can be employed in the form of a modified succinimide which is obtained by reacting succinimide with boric acid, alcohol, aldehyde, ketone, alkylphenol, cyclic carbonate (e.g., ethylene carbonate), or an organic acid. Preferred is a boron-containing alkenyl- or alkylsuccinimide which is obtained by reaction with boric acid or a boron compound. The resulting modified succinimide compound exhibits high thermal stability and high anti-oxidation property.

The lubricating oil composition of the present invention can contain other ashless dispersants such as nitrogen-containing ashless dispersants (e.g., mono-structure type alkenyl- or alkylsuccinimide, and an alkenylbenzylamine) and/or dispersants containing no nitrogen atoms such as an alkenyl succinic ester in addition to the bis-structure alkenyl or alkyl succinimide.

Zinc Dialkyldithiophosphate

The zinc dialkyldithiophosphate employed in the lubrication oil composition of the present invention has a secondary alkyl group and will be in the amount of 0.007 to 0.15 wt %, preferably 0.036 to 0.072 wt %, based on the total amount of the lubricating oil composition and expressed in terms of the phosphorus content. The alkyl group preferably contains 3 to 18 carbon atoms. All of the two alkyl groups of the zinc dialkyldithiophosphate can be secondary alkyl groups. Otherwise, a portion (e.g., a relatively small portion such as less than 48 mole %) of the alkyl groups of the zinc dialkyldithiophosphate can be a primary alkyl group. The secondary-alkyl type zinc dialkyldithiophosphate can be employed in combination with a zinc dialkyldithiophosphate having a primary alkyl group. In this case, the former zinc dialkyldithiophosphate is generally employed in an amount of 52 to 98 mole %, and the latter zinc dialkyldithiophosphate can be employed in an amount of 2 to 48 mole %.

Other Additives

The lubricating oil composition of the present invention can further contain other oxidation inhibitors, such as phenol oxidation inhibitors and/or amine oxidation inhibitors, in an amount of 0.01 to 5 wt %, preferably 0.1 to 3 wt %.

The lubrication oil composition of the present invention can further contain a multi-functional molybdenum-containing compound in an amount of 0.01 to 5 wt %, preferably 0.1 to 3 wt %. The molybdenum-containing compound mainly serves as friction-modifier, oxidation inhibitor and anti-wear agent in the lubricating oil composition of the present invention. The molybdenum-containing compound further provides effective high temperatures detergency. The molybdenum-containing compound can be incorporated into the lubricating oil composition of the present invention in an amount of 10 to 2,500 ppm in terms of the molybdenum metal content. Examples of the molybdenum-containing compounds include, but not limited to, a sulfur-containing molybdenum complex compound of succinimide, sulfurized oxymolybdenum dithiocarbamate, sulfurized oxymolybdenum dithiophosphate, an amine-molybdenum complex compound, oxymolybdenum diethylateamide, and oxymolybdenum monoglyceride. The sulfur-containing molybdenum complex compound of succinimide is particularly effective to increase detergency at high temperatures.

The lubricating oil composition of the present invention can further contain a viscosity index improver in an amount of less than 20 wt %, preferably in an amount of 1 to 20 wt %. Examples of the viscosity index improvers are such polymers as poly(alkyl methacrylate), ethylene-propylene copolymer, styrene-butadiene copolymer, and polyisoprene. Dispersant-type viscosity index improvers and multi-functional viscosity index improvers which are obtained by adding dispersancy to the above-mentioned polymers are also employable. The viscosity index improvers can be employed singly or in combination.

The lubricating oil composition of the present invention can further contain a variety of subsidiary additives. Examples of the subsidiary additives include, but not limited to, oxidation inhibitors/anti-wear agents (e.g., zinc dithiocarbamate, methylene-bis(dibutyldithiocarbamate), oil-soluble copper compounds, sulfur-containing compounds such as sulfurized olefins, sulfurized esters and polysulfides, phosphate esters, phosphite esters, and organic amide compounds such as oleylamide. Metal-deactivating compounds such as benzotriazol compounds and thiaziazol compounds also can be employed. Anti-rust agents and de-emulsifiers such as nonionic surfactants (e.g., polyoxyethylene alkylphenyl ether, and copolymer of ethylene oxide and propylene oxide) also can be employed. Friction modifiers such as amines, amides, amine salts, their derivatives, and fatty acid esters of polyhydric alcohols and their derivatives also can be employed. Anti-foaming agents and pour point depressants also can be employed. Each of the subsidiary additives is generally contained in the lubricating oil composition of the present invention in an amount of less than 3 wt %, preferably in the range of 0.001 to 3 wt %.

EXAMPLES

The invention will be further illustrated by the following examples, which set forth particularly advantageous method embodiments. While the Examples are provided to illustrate the present invention, they are not intended to limit it.

Example 1

A lubricating oil composition (TBN: 30 mg·KOH/g, SAE viscosity grade: SAE 40) was prepared using the following additives and base oil:

a) overbased calcium carboxylate (TBN: 145 mg·KOH/g, a mixture of a compound of the aforementioned formula in which R has 12 to 18 carbon atoms and a compound of the formula in which R has 20 to 28 carbon atoms, in a weight ratio of 50:50 in an amount of 1.15 wt % in terms of Ca content;
b) bis-structure succinimide dispersant (nitrogen content 0.018 wt %, prepared by reaction between polyalkylene polyamine (containing nitrogen atoms of 5.0 (mean number) in a molecule) and a product produced by thermal reaction of polybutene (number average molecular weight: approx. 1,000, having at least 50 mole % of methylvinylidene structure) and maleic anhydride) in an amount of 0.018 wt % in terms of N content;
c) zinc di(secondary)alkyldithiophosphate (P 0.049 wt %, Zn 0.054 wt %, S 0.14 wt %, prepared using a secondary alcohol containing 3 to 8 carbon atoms) in an amount of 0.05 wt % in terms of P content;
d) base oil (dynamic viscosity at 40° C.: 140 $mm^2$/sec.) of the remaining amount.

Comparative Example A

A lubricating oil composition having the same composition of Example 1 except for containing no bis-succinimide (component b) was prepared.

Comparative Example B

A lubricating oil composition having the same composition of Example 1 except for containing neither bis-structure succinimide (component b) nor zinc di(secondary)alkyldithiophosphate (component c) was prepared.

Comparative Example C

A lubricating oil composition having the same composition of Example 1 except for replacing the zinc di(secondary) alkyldithiophosphate (component c) with a zinc di(primary) alkyldithiophosphate was prepared. The phosphorus content of the latter di(primary)alkyldithiophosphate was the same as that of the former zinc di(secondary)alkyldithiophosphate.

Comparative Example D

A lubricating oil composition having the same composition of Example 1 except for replacing the bis-succinimide (component b) with a mono-succinimide dispersant was prepared.

Evaluation of Thermal Stability at High Temperatures

The thermal stability of the lubrication oil compositions at high temperatures was evaluated using the JIS (Japanese Industrial Standard) K2514 ISOT (Indiana Stirred Oxidation Test). This test is used to determine the oxidation stability of a lubricating oil composition in the presence of copper, steel and heat.

(1) ISOT test was performed under the following conditions:
Amount of oil: 250 mL
Temperature of the test oil: 165.5° C.
Test period: continuous operation for 96 hours
Test results are determined and expressed as follows:
Viscosity increase: determined at 40° C. after the continuous operation, expressed as a relative value to the viscosity (as "1") of the test oil before the operation;
TBN retention (HCl): in terms of %, measured using HCl, and
TBN retention (ASTM D2896): determined according to ASTM D2896.

(2) Test results
Test results are set forth in the following Table:

| | | Comparative Example | | | |
|---|---|---|---|---|---|
| | Example 1 | A | B | C | D |
| Viscosity increase | 0.97 | 1.21 | 1.19 | 1.18 | 1.16 |
| TBN retention (HCl) | 65.0 | 61.5 | 60.7 | 60.5 | 60.8 |
| TBN retention (ASTM D2896) | 92.4 | 89.9 | 86.3 | 87.1 | 88.8 |

Remarks:
The lubricating oil composition of Example 1 gave a viscosity increase of 1.02 after additional 24 hours ISOT test (total: 120 hours).

The lubricating oil composition of the present invention provides low viscosity increase and shows high TBN retention. Accordingly, it is clear that the lubricating oil composition of the present invention has high anti-thermal oxidation property at high temperatures.

What is claimed is:

1. A lubricating oil composition having a total base number (TBN) in the range of 5 to 55 mg KOH/g comprising a major amount of a base oil of lubricating viscosity and a) 0.19 to 2.10 wt %, based on the total amount of the lubricating oil composition, of an overbased calcium carboxylate having a TBN of 100 mg KOH/g or more comprising each of the following compound A and the following compound B, wherein the wt % is expressed in terms of the calcium content, and wherein the overbased calcium carboxylate having a TBN of 100 mg KOH/g or more comprises more than 50 wt % of the following compound A and less than 50 wt % of the following compound B:

Compound A

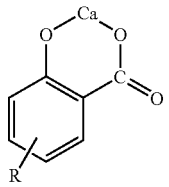

Compound B

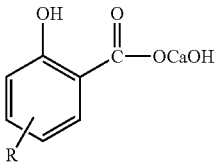

in which R is an alkyl group having 12 to 28 carbon atoms; b) 0.002 to 0.06 wt %, based on the total amount of the lubricating oil composition, of a bis-succinimide compound, wherein the wt % is expressed in terms of the nitrogen content; and c) 0.007 to 0.15 wt %, based on the total amount of the lubricating oil composition, of a zinc dialkyldithiophosphate having a secondary alkyl group, wherein the wt % is expressed in terms of the phosphorus content.

2. The lubricating oil composition according to claim 1, wherein the amount of the overbased calcium carboxylate having a TBN of 100 mg·KOH/g or more is in the range of 0.38 to 1.15 wt %, based on the total amount of the lubricating oil composition and expressed in terms of the calcium content.

3. The lubricating oil composition according to claim 1, wherein the amount of the bis-succinimide compound is in the range of 0.014 to 0.02 wt %, based on the total amount of the lubricating oil composition and expressed in terms of the nitrogen content.

4. The lubricating oil composition according to claim 1, wherein the amount of the zinc dialkyldithiophosphate having a secondary alkyl group is in the range of 0.036 to 0.072 wt %, based on the total amount of the lubricating oil composition and expressed in terms of the phosphorus content.

5. The lubricating oil composition according to claim 1, wherein the bis-succinimide compound is prepared by a thermal reaction between a poly-butene compound containing 50% or more methylvinylidene structure and maleic anhydride, followed by further reaction of the resulting polybutenyl, succinic anhydride with a polyalkylenepolyamine containing 4 to 10 nitrogen atoms per molecule.

6. The lubricating oil composition according to claim 1, wherein the zinc dialkyldithiophosphate having a secondary alkyl group comprises alkyl groups independently having 3 to 8 carbon atoms.

7. A method of improving the oxidation stability at high temperatures of an internal combustion engine, said method comprising operating the internal combustion engine with a lubricating oil composition having a TBN in the range of 5 to 55 mg KOH/g comprising a base oil of lubricating viscosity and a) 0.19 to 2.10 wt %, based on the total amount of the lubricating oil composition, of an overbased calcium carboxylate having a TBN of 100 mg KOH/g or more comprising each of the following compound A and the following compound B, wherein the wt % is expressed in terms of the calcium content and wherein the overbased calcium carboxylate having a TBN of 100 mg KOH/g or more comprises more than 50 wt % of the following compound A and less than 50 wt % of the following compound B:

Compound A

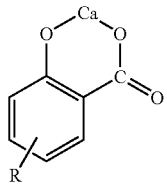

Compound B

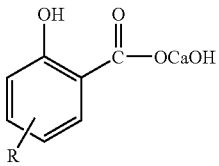

in which R is an alkyl group having 12 to 28 carbon atoms; b) 0.002 to 0.06 wt %, based on the total amount of the lubricating oil composition, of a bis-succinimide compound, wherein the wt % is expressed in terms of the nitrogen content; and c) 0.007 to 0.15 wt %, based on the total amount of the lubricating oil composition, of a zinc dialkyldithiophosphate having a secondary alkyl group, wherein the wt % is expressed in terms of the phosphorus content.

8. The method according to claim 7, wherein the internal combustion engine is a four stroke trunk piston diesel engine.

* * * * *